United States Patent [19]

Sugiyama

[11] Patent Number: 4,963,760

[45] Date of Patent: Oct. 16, 1990

[54] STARTER FOR ENGINE

[75] Inventor: Takeshi Sugiyama, Hyogo, Japan

[73] Assignee: Mitsubishi Denki Kabushiki Kaisha, Tokyo, Japan

[21] Appl. No.: 293,780

[22] Filed: Jan. 4, 1989

[30] Foreign Application Priority Data

Jan. 20, 1988 [JP] Japan ..... 63-6584[U]

[51] Int. Cl.[5] ..... F02N 11/00

[52] U.S. Cl. ..... 290/48; 74/7 E

[58] Field of Search ..... 290/48; 74/7 R, 7 A, 74/7 C, 7 E

[56] References Cited

U.S. PATENT DOCUMENTS

| | | | |
|---|---|---|---|
| 4,274,292 | 6/1981 | Arnett, Jr. | 74/7 E X |
| 4,454,437 | 1/1984 | Tanaka et al. | 310/83 |
| 4,519,261 | 5/1985 | Hamano | 74/7 E |
| 4,525,632 | 6/1985 | Tanaka | 290/48 X |
| 4,592,243 | 6/1986 | Katoh et al. | 74/7 E |
| 4,707,616 | 11/1987 | Ogle et al. | 290/48 |

*Primary Examiner*—A. D. Pellinen
*Assistant Examiner*—W. E. Duncanson, Jr.
*Attorney, Agent, or Firm*—Sughrue, Mion, Zinn, Macpeak & Seas

[57] ABSTRACT

A starter comprises an electric motor which produces torque for starting an engine; a speed reduction planet gear unit in which a carrier by which a plurality of planet gears are rotatably supported is integrally formed with a rotary shaft disposed coaxially with the armature shaft of the electric motor, so that the rotary shaft is rotated at a lower speed than the armature shaft as the torque of the armature shaft is transmitted to the rotary shaft; an output rotary shaft provided with a speed reduction gear engaged with the gear formed on the rotary shaft; and a pinion supported on the output rotary shaft so that the pinion can be engaged with and disengaged from the ring gear of the engine and can be rotated by the torque of the inner member of the clutch.

5 Claims, 1 Drawing Sheet

STARTER FOR ENGINE

BACKGROUND OF THE INVENTION

The present invention relates to a starter for an engine, particularly to the improvement of a motive power transmission system extending from an electric motor to a pinion in a starter for starting the engine of a vehicle.

FIG. 2 shows a conventional starter 1 which is of the so-called side mount type and used to start the engine of a vehicle. The starter 1 comprises a DC motor 2, an output rotary shaft 3 extending in parallel with an armature shaft 2*a* of the DC motor, a speed reduction gear 4 engaged with a gear 2*b* provided on the armature shaft, an overrunning clutch 5 slidably supported on the output rotary shaft, a pinion 6 integrated or coupled with the inner member (not shown in the drawing) of the overrunning clutch and a shift lever 8 which is engaged at one end thereof with the actuation rod 7*a* of an electromagnetic switch 7 disposed alongside the DC motor and is engaged at the other end thereof with the overrunning clutch, to slide the clutch together with the pinion on the output rotary shaft. Since the number of the teeth of the pinion 6 is made as many as about twenty due to the restrictive condition of the mounting of the starter on the vehicle although the number of the teeth of the pinion of an ordinary starter is about eight, the torque transmitted to the engine by the starter shown in FIG. 2 is relatively low. For that reason, the speed reduction gear 4 is used to increase the speed reduction ratio of the starter to heighten the transmitted torque. However, the increase in the speed reduction ratio is not large enough. It is conceivable that either the torque of the DC motor 2 or the internal speed reduction ratio of the starter is increased in order to heighten the torque transmitted to the engine by the starter. However, increasing the torque of the DC motor 2 is not preferable because it results in making the starter heavier or larger. Besides, increasing the internal speed reduction ratio of the starter is also not preferable because it results in greatly augmenting the number of the parts of the starter to make the manufacturing of the starter more troublesome and the cost thereof higher. This is a problem.

SUMMARY OF THE INVENTION

The present invention was made in order to solve the above-mentioned problem.

Accordingly, it is an object of the present invention to provide a starter relatively simple in constitution and high in torque transmitted to an engine by the starter. The starter comprises an electric motor which produces the torque for starting the engine; a speed reduction planet gear unit in which a carrier, by which a plurality of planet gears are rotatably supported, is integrally formed with a rotary shaft disposed coaxialy with the armature shaft of the electric motor, so that the rotary shaft is rotated at a lower speed than the armature shaft as the torque of the armature shaft is transmitted to the rotary shaft; a gear formed on the rotary shaft; an output rotary shaft provided with a speed reduction gear engaged with the gear formed on the rotary shaft; an overrunning clutch slidably supported on the output rotary shaft; and a pinion supported on the output rotary shaft so that the pinion can be engaged with and disengaged from the ring gear of the engine and can be rotated by the torque of the inner member of the overrunning clutch. The torque of the armature shaft of the electric motor is transmitted to the output rotary shaft through the speed reduction planet gear unit and the speed reduction gear so that the output rotary shaft is rotated at a lower speed than the armature shaft due to both the speed reducing action of the speed reduction planet gear unit and that of the speed reduction gear. The torque of the output rotary shaft is transmitted to the inner member of the overrunning clutch to rotate the pinion engaged with the ring gear of the engine, to start the engine.

Since the output rotary shaft is rotated at the lower speed than the armature shaft of the electric motor due to both the speed reducing action of the speed reduction planet gear unit and that of the speed reduction gear as the torque of the armature shaft is transmitted to the output rotary shaft through the speed reduction planet gear unit and the speed reduction gear, the speed reduction ratio of the starter is so large that the torque transmitted from the electric motor to the engine is high enough to start the engine well. Since the carrier of the speed reduction planet gear unit is integrally formed with the rotary shaft thereof and the gear of the unit is formed on the rotary shaft and engaged with the speed reduction gear, the constitution of the starter is simple despite the double-stage speed reduction by both the speed reduction planet gear unit and the speed reduction gear. For that reason, it is not troublesome to manufacture the starter, and the cost thereof is not very high.

DETAILED DESCRIPTION OF THE EXEMPLARY EMBODIMENT

An embodiment of the present invention is described hereinafter with reference to the accompanying drawings.

Figure 1:
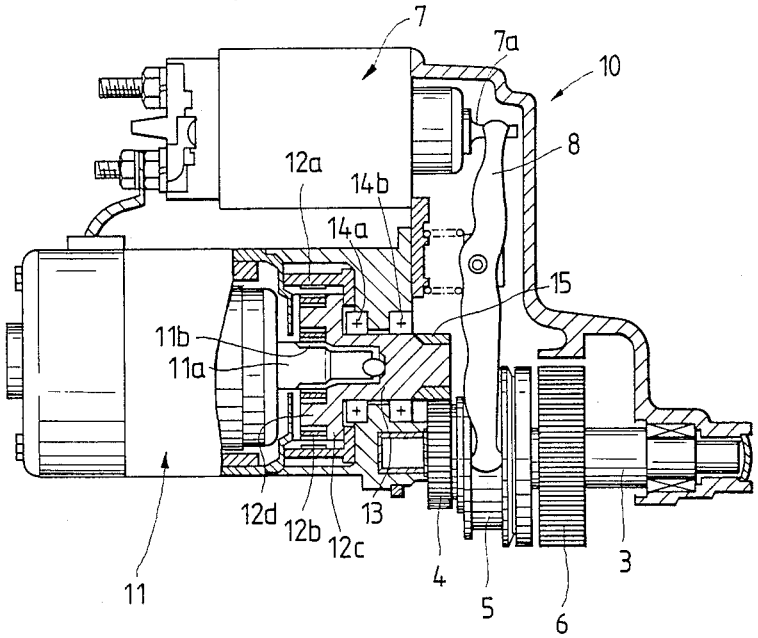
FIG. 1 shows a partially sectional view of a starter which is an embodiment of the present invention.
Figure 2:
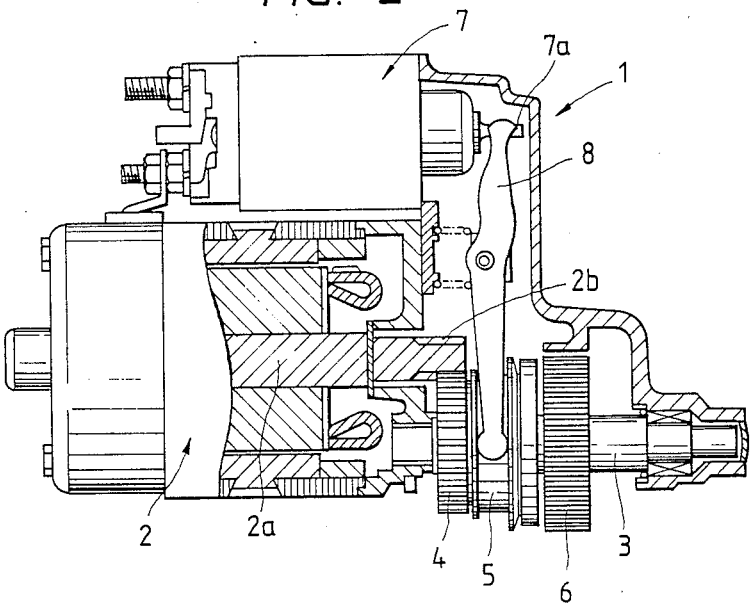
FIG. 2 shows a partially sectional view of a conventional starter.

FIG. 1 shows a starter 10 which is the embodiment. The starter 10 includes a DC motor 11 which produces torque for starting the engine of a vehicle. A sun gear 11*b* is formed on the peripheral surface of the front portion (right-hand portion as to FIG. 1) of an armature shaft 11*a* of the DC motor 11. An internal gear 12*a* is secured around the sun gear 11*b* concentrically thereto. A plurality of planet gears 12*b* are engaged with the sun gear 11*b* and the internal gear 12*a* so that the planet gears are revolved around the armature shaft 11*a*. The planet gears 12*b* are rotatably supported by pins 12*d* provided on a carrier 12*c* integrally formed with a rotary shaft 13 disposed in front of the armature shaft 11*a* coaxially therewith and supported by bearings 14*a* and 14*b* located at a distance from each other along the axis of the rotary shaft so that the axis of the rotary shaft is prevented from eccentrically whirling. A gear 15 is formed on the peripheral surface of the front end portion of the rotary shaft 13. A speed reduction gear 4 is engaged with the gear 15. The sun gear 11*b* formed on the armature shaft 11*a*, the internal gear 12*a*, the planet gears 12*b* and the carrier 12*c* having the pins 12*d* constitute the speed reduction planet gear unit 12 of the starter 10. The starter 10 also includes an output rotary shaft 3 extending in parallel with the armature shaft 11*a*, an overrunning clutch 5 slidably supported on the output rotary shaft, a pinion 6 integrated or coupled with the inner member of the overrunning clutch, an electromagnetic switch 7 provided alongside the DC motor 2, and a shift lever 8 which is engaged at one end thereof with the actuation rod *7a* of the electromagnetic switch and engaged at the other end thereof with the overrunning clutch in order to slide the clutch together with the pinion on the output rotary shaft.

When the ignition switch of the vehicle is turned on, the electromagnetic switch 7 is energized to attract the actuation rod *7a* thereof to swing the shift lever 8. As a result, the overrunning clutch 5 is slid forward together with the pinion 6 on the output rotary shaft 3 so that the pinion 6 is engaged with the ring gear of the engine. Nearly at the same time as the engagement of the pinion 6 with the ring gear or immediately before the engagement, the fixed and movable contacts of the electromagnetic switch 7 are put in touch with each other due to the movement of the actuation rod *7a* of the switch to supply electric power to the DC motor 11 to rotate the armature shaft 11*a* thereof. The torque of the armature shaft 11*a* is transmitted to the output rotary shaft 3 through the speed reduction planet gear unit 12 and the speed reduction gear 4 so that the output rotary shaft is rotated at a lower speed than the armature shaft due to the speed reducing action of the planet gear unit and that of the speed reduction gear. The torque of the output rotary shaft 3 is transmitted to the pinion 6 through the overrunning clutch 5. Since the torque of the DC motor 11 is transmitted to the output rotary shaft 3 so that the rotation of the output rotary shaft is made slower than that of the DC motor due to both the speed reducing action of the speed reduction planet gear unit 12 and that of the speed reduction gear 4, the speed reduction ratio of the starter 10 is so large that the torque transmitted to the engine is high enough to start the engine well although the DC motor is compact.

What is claimed is:

1. A starter comprising:

an electric motor, comprising an armature shaft, which produces torque on said shaft for starting an engine;

a speed reduction planet gear unit in which a carrier by which a plurality of planet gears are rotatably supported is integrally formed with a rotary shaft disposed coaxially with said armature shaft of said motor, so that said rotary shaft is rotated at a lower speed than said armature shaft as the torque of said armature shaft is transmitted to said rotary shaft;

a gear formed on said rotary shaft;

an output rotary shaft provided with a speed reduction gear engaged with said gear formed on said rotary shaft;

an overrunning clutch slidably supported on said output rotary shaft; and a pinion supported on said output rotary shaft so that said pinion can be engaged with and disengaged from the ring gear of said engine and can be rotated by the torque of the inner member of said clutch.

2. A starter for an engine comprising:

an electric motor having an armature shaft to produce torque for stating said engine;

a speed reduction planet gear unit including a sum gear formed on said armature shaft, an internal gear, a carrier having pins and a plurality of planet gears rotatably supported by pins, respectively;

a rotary shaft integrally formed with said carrier and provided with a gear on the peripheral surface at one end thereof;

an output rotary shaft extending in parallel with said armature shaft;

a speed reduction gear provided with said output rotary shaft;

an overrunning clutch slidably supported on the output rotary shaft; and a pinion integrated/coupled with the inner member of the overrunning clutch.

3. A starter of claim 2, wherein said gear of said rotary shaft is engaged with said speed reduction gear of said output rotary shaft so that said output rotary shaft is rotated at a lower speed than said rotary shaft.

4. A starter of claim 2, wherein the torque of said armature shaft is transmitted to said output rotary shaft through said speed reduction planet gear unit and said speed reduction gear so that said output rotary shaft is rotated at a lower speed than said armature shaft due to the speed reducing action of said planet gear unit and that of said speed reduction gear.

5. A starter of claim 2 further comprising:

an electromagnetic switch provided alongside said electric motor; and a shift lever which is engaged at one end thereof with the actuation rod of the electromagnetic switch and engaged at other end thereof with said overrunning clutch in order to slide said clutch together with said pinion on said output rotary shaft.

* * * * *